US011236567B2

(12) United States Patent
Eidem et al.

(10) Patent No.: US 11,236,567 B2
(45) Date of Patent: Feb. 1, 2022

(54) CUTTING TOOL WITH PIVOTALLY FIXED CUTTERS

(71) Applicant: EQUINOR ENERGY AS, Stavanger (NO)

(72) Inventors: Morten Eidem, Trondheim (NO); Gaute Grindhaug, Hafrsfjord (NO)

(73) Assignee: EQUINOR ENERGY AS, Stavanger (NO)

( * ) Notice: Subject to any disclaimer, the term of this patent is extended or adjusted under 35 U.S.C. 154(b) by 0 days.

(21) Appl. No.: 16/630,298

(22) PCT Filed: Jul. 9, 2018

(86) PCT No.: PCT/NO2018/050182

§ 371 (c)(1),
(2) Date: Jan. 10, 2020

(87) PCT Pub. No.: WO2019/013645

PCT Pub. Date: Jan. 17, 2019

(65) Prior Publication Data

US 2020/0217158 A1 Jul. 9, 2020

(30) Foreign Application Priority Data

Jul. 13, 2017 (GB) ..... 1711287

(51) Int. Cl.
*E21B 29/00* (2006.01)
*E21B 10/32* (2006.01)

(52) U.S. Cl.
CPC ..... *E21B 29/005* (2013.01); *E21B 10/32* (2013.01)

(58) Field of Classification Search
CPC ..... E21B 10/32; E21B 29/005; E21B 29/002; E21B 10/322; E21B 10/325; E21B 10/327
See application file for complete search history.

(56) References Cited

U.S. PATENT DOCUMENTS 1,022,129 A * 4/1912 Evans ..... E21B 10/32 175/263
2,188,409 A * 1/1940 Lane ..... E21B 29/005 166/55.7

(Continued)

FOREIGN PATENT DOCUMENTS

GB 2 372 056 A 8/2002
WO WO 2004/104361 A1 12/2004

OTHER PUBLICATIONS

International Search Report, issued in PCT/NO2018/050182, dated Aug. 29, 2018.

(Continued)

*Primary Examiner* — Caroline N Butcher
(74) *Attorney, Agent, or Firm* — Birch, Stewart, Kolasch & Birch, LLP

(57) ABSTRACT

A tool for use in a borehole to perform a milling, under reaming, or other cutting operation includes a tool body configured for rotation about its longitudinal axis, within the borehole, and a set of cutters, the set including two or more cutters which, at least in a deployed configuration, extend outwardly from the tool body and are fixedly coupled together whilst being pivotally coupled to the tool body substantially on said axis so that the cutters rotate with the tool body whilst being pivotable together relative to the tool body during cutting.

6 Claims, 2 Drawing Sheets

(56) References Cited

U.S. PATENT DOCUMENTS

| | | | | | |
|---|---|---|---|---|---|
| 2,216,895 | A * | 10/1940 | Stokes | E21B 10/322 | 175/269 |
| 4,431,065 | A * | 2/1984 | Andrews | E21B 10/567 | 175/269 |
| 4,938,291 | A * | 7/1990 | Lynde | B23B 5/16 | 166/55.8 |
| 5,074,355 | A * | 12/1991 | Lennon | E21B 10/322 | 166/55.1 |
| 5,201,817 | A * | 4/1993 | Hailey | E21B 10/322 | 166/55.8 |
| 5,265,675 | A * | 11/1993 | Hearn | E21B 10/322 | 166/297 |
| 5,671,816 | A | 9/1997 | Tibbitts | | |
| 5,732,770 | A * | 3/1998 | Beeman | E21B 29/005 | 166/55.8 |
| 7,143,847 | B2 * | 12/2006 | Pia | E21B 47/095 | 175/263 |
| 7,909,100 | B2 * | 3/2011 | Bryant, Jr. | E21B 29/005 | 166/298 |
| 9,187,971 | B2 * | 11/2015 | Hutchinson | E21B 29/005 | |
| 10,202,814 | B2 * | 2/2019 | Fuller | E21B 33/13 | |
| 2005/0205305 | A1 * | 9/2005 | Stout | E21B 10/322 | 175/292 |
| 2011/0297379 | A1 * | 12/2011 | Laird | E21B 29/005 | 166/298 |
| 2012/0205157 | A1 * | 8/2012 | Radford | E21B 10/322 | 175/57 |

OTHER PUBLICATIONS

United Kingdom Combined Search and Examination Report, issued in Priority Application No. 1711287.1, dated Nov. 30, 2017.

Written Opinion of the International Searching Authority, issued in PCT/NO2018/050182, dated Aug. 29, 2018.

* cited by examiner

CUTTING TOOL WITH PIVOTALLY FIXED CUTTERS

TECHNICAL FIELD

The present invention relates to a self-adjusting downhole tool and more particularly to a self-adjusting downhole tool for removing a material, such as an under reamer or a milling tool.

BACKGROUND

Following the initial drilling of a wellbore or borehole into a formation, it is sometimes necessary to under ream or enlarge the borehole. For example, it may be required that the diameter of a borehole be larger than can be achieved with a drill bit that currently fits inside the borehole. Alternatively, if the drill bit has worn down during the drilling of the borehole, then a section of the borehole may not be as large as it should be, or a section of the wall of the borehole may have collapsed or moved into the borehole, at least partially obstructing the borehole.

FIG. 1 illustrates a conventional borehole enlargement tool or under reamer 10 that consists of a tubular body 11 attached to or within the drill string, and which has multiple radially-projecting blades or arms 12 spaced around its circumference. The blades are retractable/extendable, e.g. by means of a hydraulically activated pushing rod 14, activating hydraulic force $F_2$, and an internal ramp 15 for the arms to slide on forcing the arms out of the body. The blades are provided with cutting edges or elements 13 on their ends or tips. In use, the under reamer 10 is rotated within the borehole such that the cutting elements 13 on the projecting blades make contact with the edges or walls of the borehole, dislodging formation material and enlarging the borehole.

FIG. 2 illustrates a conventional milling tool such as might be used to remove, by milling, a section of tubulars located within the borehole. This might be required for example in order to prepare the borehole for a temporary or permanent plug and abandon (P&A) operation, where a section of the borehole is cleared to expose the formation and allow that section to be filled with a sealant such as cement. As with the under reamer of FIG. 1, the milling tool is provided with a number of milling blades 22 each of which is moveable to a deployed position by means of a hydraulically activated pushing piston or rod 24 and activating hydraulic force $F_2$ pushing the blades open.

Typically, for both milling tools and under reamers, once the blades (or cutters) are deployed they are fixed in position 23 relative to the tool body 21 with no possibility for subsequent adjustment. As the tools are rotating it is possible for load to be unevenly distributed between the blades causing excessive and uneven wear to the blades. For example, in the case of a milling tool which is being pulled upward or pushed downward during milling, one of the blades may have a higher/lower cutting surface than the other blades meaning that this blade will be doing most of the milling work, causing that blade to wear excessively. This in turn can reduce the milling speed and result in the need to replace blades more frequently than would otherwise be the case. An uneven load may also cause vibration in the tool which can exacerbate the problem and/or cause other damage to the tool and associated components, e.g. sensitive electronic components.

SUMMARY

It is an object of the present invention to provide a milling tool or under reamer that provides for reduces wear on individual blades and/or which increases operating efficiency.

According to the present invention there is provided a tool for use in a borehole to perform a milling, under reaming, or other cutting operation. The tool comprises a tool body configured for rotation about its longitudinal axis, within the borehole, and a set of cutters, the set comprising two or more cutters which, at least in a deployed configuration, extend outwardly from the tool body and are fixedly coupled together whilst being pivotally coupled to the tool body substantially on said axis so that the cutters rotate with the tool body whilst being pivotable together relative to the tool body during cutting.

The cutters of said set of cutters may be spaced substantially equiangularly around the tool.

The tool may comprise a set of arms fixedly connecting respective cutters to a centre point on said axis, the arms being fixedly connected together at the centre point and to the tool by a pivotable coupling.

The tool may comprise two or more of said sets of cutters, the cutters of each set being pivotable relative to the tool body independently of the cutters of the or each other set of cutters.

The set of cutters may comprise two cutters.

The tool may comprise a deployment mechanism for holding the cutters in a retracted position substantially within the tool body to enable lowering of the tool into the borehole and for deploying the cutters radially outwardly to said deployed position.

DETAILED DESCRIPTION

As has been discussed above, conventional milling tools and under reamers, such as are used to remove material from within a borehole, make use of blades and cutters that are rigidly fixed to the tool body at least following deployment, i.e. radial extension.

This can lead to uneven wear on the blades as well as other problems.

In order to mitigate these problems it is proposed here to couple the blades to the tool body so as to allow for a degree of movement between the blades and the tool body and moreover to link the blades together to help share and adjust the loads on the individual blades. This linkage can take various forms depending on what is to be achieved but, in short, the object is to transfer part of the load from one blade experiencing a high load to another blade experiencing a lower load, thereby more evenly distributing the load. A benefit may be increased tool lifetime as even wear over the cutters may prevent premature tool failure and/or faster milling or under reaming speeds. Further benefits include extended milling lengths and reduced number of trips into the borehole.

Figure 1:
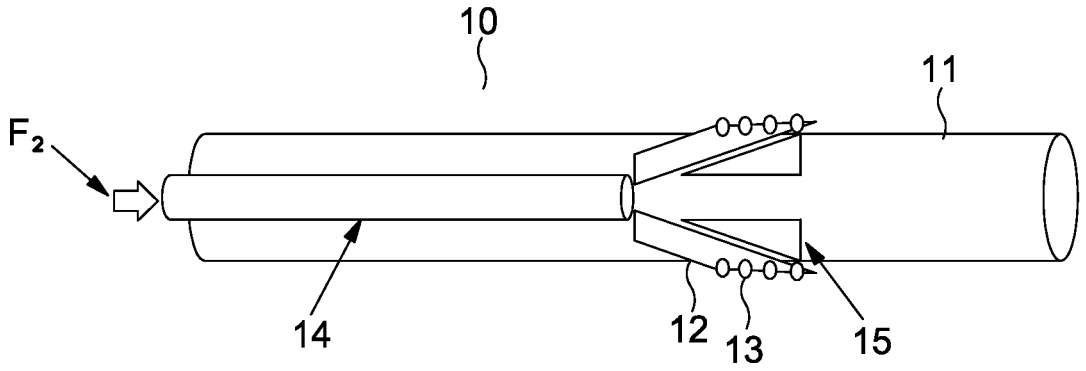
FIG. 1 illustrates schematically a conventional under reamer comprising a plurality of reamer blades.
Figure 2:
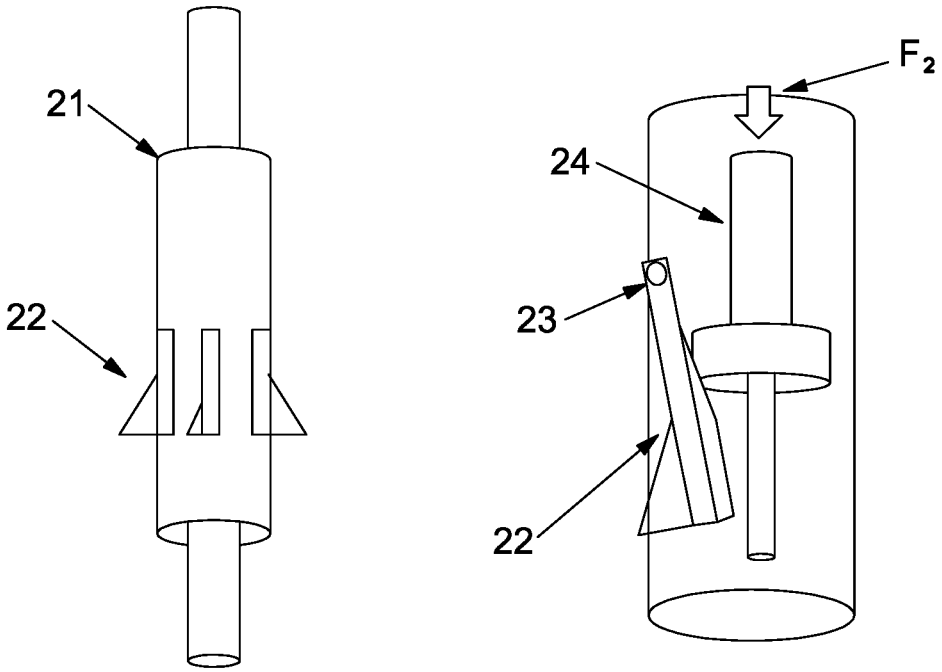
FIG. 2 illustrates schematically a conventional milling tool comprising a plurality of milling blades.
Figure 3:
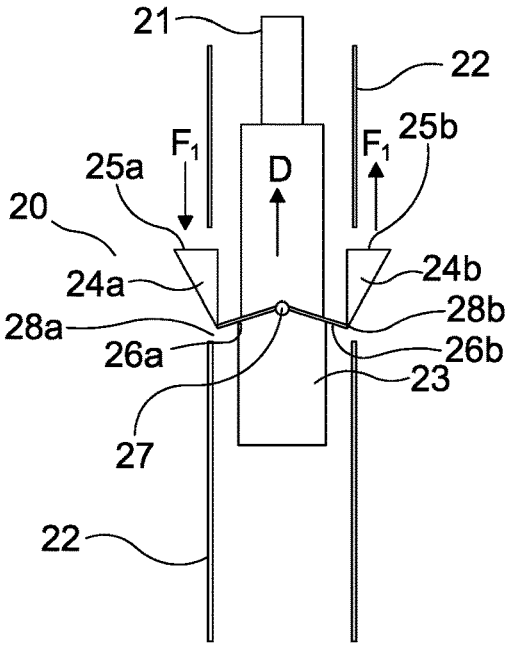
FIG. 3 illustrates schematically a milling tool according to an embodiment of the invention and comprising a pair of milling blades secured together and pivotable relative to a tool body.

FIG. 3 illustrates schematically a tool 20 deployed within a borehole (not shown) on the end of a drill pipe 21. In this example the borehole contains one or more tubulars 22 such as a casing, as well as possibly other downhole equipment such as cables, conduits etc. As part of a plug and abandon operation a section of the tubulars and other equipment must be removed by milling. As such, the tool 20 is a milling tool comprising a tool body 23 secured to the drill pipe and a pair of cutters 24*a*, 24*b*. Each cutter has an upwardly facing cutting surface 25*a*, 25*b* to allow milling to be performed as the drill pipe and tool are rotated whilst being pulled upwardly through the borehole. [NB. The principle described here can be used regardless of the milling direction.]

The cutters 24*a*, 24*b* are attached to respective arms 26*a*, 26*b*, with the arms being connected together at a centre point of the tool body. In the fully deployed state shown in FIG. 3, the arms are secured together at a fixed angle, whilst being able to pivot about a pivot point 27. Pivoting is preferably permitted only in the plane of the Figure although pivoting out of that plane may also be possible.

FIG. 3 illustrates a situation where one of the cutters 24*a* is being subjected to a greater downward force than the other cutter 24*b*, resulting in a differential force F1 between the cutters. As a result of the arms and pivot point, this differential force is transferred from one cutter to the other, i.e. a downward force on one cutter 24*a* is transferred to an upward force on the other cutter 24*b*. This action tends to equalize the work performed by the two cutters. The direction of milling D is also indicated.

Although not shown in FIG. 3, a suitable mechanism is provided for radially deploying the cutters prior to commencing milling. Typically, the cutters and arms are contained wholly within the tool body 23 during lowering of the tool 20 into the borehole. In this configuration the arms are folded inward. Once the tool 20 is at the correct location, the drill pipe 21 is rotated and the arms and cutters are pushed radially outward, e.g. using some hydraulic mechanism, through longitudinal slots 28*a*, 28*b* provided in the tool body. The cutters 24*a*,24*b* are shaped to enable initial penetration of the tubulars to be cut. Rotation and radial deployment continue until the arms and cutters are fully expanded at which point the arms are locked together so that they pivot together about the pivot point 27. This process may be reversed following completion of the milling operation in order to withdraw the arms and cutters wholly into the tool body, allowing the drill pipe and tool to be pulled up and out of the borehole.

Figure 4:
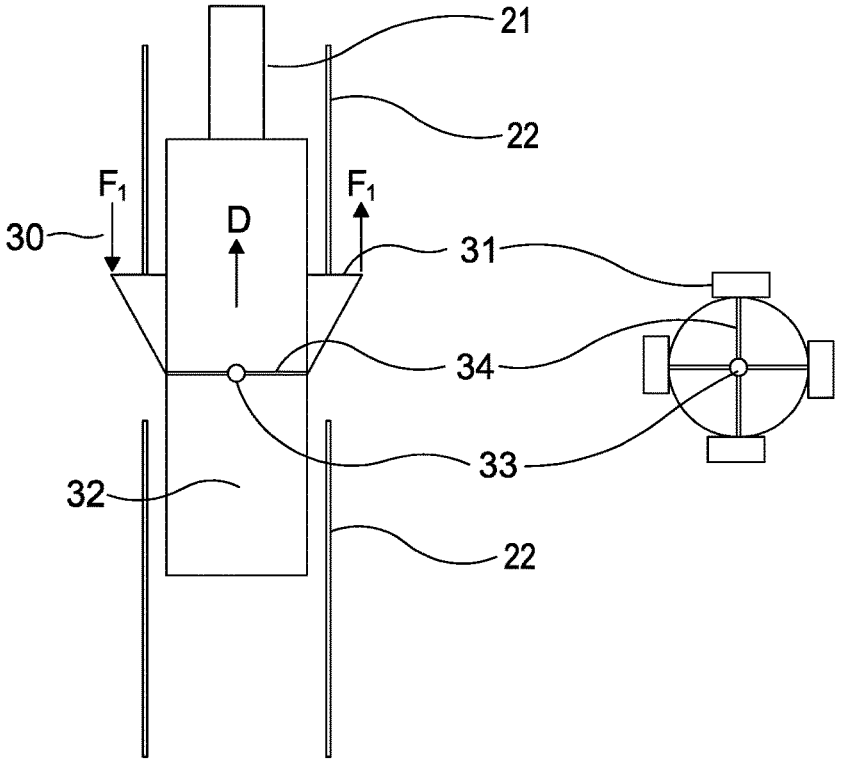
FIG. 4 illustrates schematically a milling tool according to an alternative embodiment of the invention and comprising a set of four of milling blades secured together and pivotable relative to a tool body.

FIG. 4 illustrates (as a side cross-sectional view and a transverse cross-sectional view taken through the cutters) an alternative milling tool 30 which, when fully deployed, presents four equally spaced cutters 31 secured to a tool body 32 at a pivot point 33 via respective arms 34 [the principle described here is independent of the number of cutters. For example, in an alternative embodiment six cutters may be employed.]. The arms 34 and cutters 31 may be arranged in pairs, with diametrically opposing arms and cutters being connected to pivot together about the pivot point. In other words, each pair of diametrically opposed cutters and arms is able to pivot about the pivot point independently of the other pair of diametrically opposed cutters and arms. As with the embodiment of FIG. 3, for each pair of cutters, any force imbalance is transferred through the arms in order to tend to balance the work that is performed by the cutters of each pair.

In a modification to the embodiment of FIG. 3, all four arms may be rigidly fixed together following full radial deployment, with the arms pivoting together about the pivot point. In this case the pivot point is provided by a universal joint or the like connecting the innermost ends of the arms to the tool body.

In addition to balancing the downward forces exerted on the cutters, the arrangements described above can also reduce the uneven sideways force when cutters bite into the tubulars or formation, thereby tending to centre the tool and reduce the amount of vibration caused by under reaming or milling operations. This also mitigates the damaging effects of any sudden side forces created if a single arm bites into formation or casing.

It will be appreciated that various modifications may be made to the above described embodiments without departing from the scope of the present invention.

The invention claimed is:

1. A tool for use in a borehole to perform a milling, under reaming, or other cutting operation and comprising:

a tool body configured for rotation about its longitudinal axis, within the borehole;

a set of cutters, the set comprising two or more cutters which, at least in a deployed configuration, extend outwardly from the tool body and are fixedly coupled together whilst being pivotally coupled to the tool body substantially on said axis so that the cutters rotate with the tool body whilst being pivotable together relative to the tool body during cutting; and a set of arms, wherein each of two or more cutters is attached to one corresponding arm of the set of arms, and the set of arms are connected together at a center point of the tool body, and wherein, in the deployed configuration, the set of arms are secured together at a fixed angle, whilst being configured to pivot about a pivot point so that a downward force on one of the two or more cutters is transferred to an upward force on another cutter of the two or more cutters.

2. The tool according to claim 1, wherein the cutters of said set of cutters are spaced substantially equiangularly around the tool.

3. The tool according to claim 1, further comprising two or more of said sets of cutters, the cutters of each set being pivotable relative to the tool body independently of the cutters of within other sets of cutters.

4. The tool according to claim 1, wherein said set of cutters comprises two cutters.

5. The tool according to claim 1, further comprising a deployment mechanism for holding the cutters in a retracted position substantially within the tool body to enable lowering of the tool into the borehole and for deploying the cutters radially outwardly to said deployed position.

6. The tool according to claim 1, wherein the two or more cutters are fixedly coupled with respect to each other, and are pivotable together with respect to the tool body during cutting without individual displacement relative to each other.

* * * * *